United States Patent [19]

Hills

[11] 4,406,850

[45] Sep. 27, 1983

[54] SPIN PACK AND METHOD FOR PRODUCING CONJUGATE FIBERS

[75] Inventor: William H. Hills, West Melbourne, Fla.

[73] Assignee: Hills Research & Development, Inc., West Melbourne, Fla.

[21] Appl. No.: 305,219

[22] Filed: Sep. 24, 1981

[51] Int. Cl.[3] ..... D01D 3/00

[52] U.S. Cl. ..... 264/171; 425/131.5; 425/198

[58] Field of Search ..... 425/131.5, 198; 264/171

[56] References Cited

U.S. PATENT DOCUMENTS

| | | | |
|---|---|---|---|
| 2,931,091 | 4/1960 | Breen | 425/131.5 |
| 3,459,846 | 8/1969 | Matsui et al. | 425/131.5 |
| 3,807,917 | 4/1974 | Shimoda et al. | 264/171 |

FOREIGN PATENT DOCUMENTS

| | | | |
|---|---|---|---|
| 1435576 | 3/1973 | Fed. Rep. of Germany | 264/171 |
| 42-18561 | 9/1967 | Japan | 425/131.5 |
| 43-7416 | 3/1968 | Japan | 425/131.5 |
| 44-16171 | 7/1969 | Japan | 425/131.5 |
| 46-41403 | 12/1971 | Japan | 425/131.5 |
| 47-21242 | 6/1972 | Japan | 425/131.5 |
| 1061692 | 3/1967 | United Kingdom | 425/131.5 |

*Primary Examiner*—Jay H. Woo

*Attorney, Agent, or Firm*—Epstein & Edell

[57] ABSTRACT

Sheath-core bi-component fibers are formed by an improvement of the method and apparatus described in U.S. Pat. No. 2,936,482 whereby molten sheath polymer is issued in ribbons into a recessed portion of the top surface of the spinneret from locations between rows of raised spinneret channel inlets. Ribbon flow of the sheath polymer is achieved in slot-like channels which are inter-leaved with rows of core polymer flow passages to optimize space utilization and spinneret channel density. Filtering of the core and sheath polymer is achieved in separate manifolds leading to the core flow passages and sheath slot-like flow channels which are kept to minimal length to minimize polymer residence time downstream of the filters.

21 Claims, 7 Drawing Figures

SPIN PACK AND METHOD FOR PRODUCING CONJUGATE FIBERS

TECHNICAL FIELD

The present invention relates to the formation of staple fibers via melt spinning. More particularly, the present invention provides a method and apparatus for achieving high filament density and short polymer residence times while spinning concentric sheath-core fibers.

BACKGROUND OF THE INVENTION

Many of the potential end uses for bi-component fibers require that the fibers be in staple (i.e.—cut) form for processing via traditional yarn spinning (woolen spinning, cotton spinning, etc.) or for processing into non-woven fabrics where the cut fibers are needed. To produce staple fibers via melt spinning economically, it is customary to employ spinnerets having the greatest practical number of holes. A common type of melt spinning spinneret to produce, for instance, two-denier polyester staple fibers (for blending with cotton fibers) would have perhaps 1000 holes in a rectangular area about 7.5 cm wide by 30 cm long. Such a pack would be described as having a high filament density (greater than four holes per square centimeter). Cool air is blown through the fibers below the spinneret across the 7.5 cm dimension.

Bi-component fibers are generally of two different types. The concentric sheath-core type, as the name implies, includes a polymer sheath fiber disposed concentrically about a polymer core fiber. The side-by-side type, on the other hand, includes two polymer fibers disposed side-by-side in parallel relationship. Of course, there are variations of these basic bi-component fiber types, such eccentric sheath-core types wherein the sheath and core fibers are not concentrically disposed. In general, side-by-side fibers are made with two polymers having different shrinkage, retraction or other behavior induced by heat and/or moisture. These fibers are generally referred to as self-crimping, since their "bi-metallic" type of behavior causes them to curl when exposed to heat and/or moisture, resulting in a more bulky fibrous mass. Sheath-core fibers with substantial behave in the same way as the side-by-side type, although their curling forces are not so great.

With all bi-component fiber manufacture via melt spinning there has been a problem delivering a supply of different polymers to each spinning orifice while retaining a high density of filaments per unit area of spinneret face. In making staple fibers, if a substantial drop in spinneret filament density is tolerated, much less fiber production will be achieved per spinning station, greatly increasing the capital cost to obtain a given level of fiber production. More spinning stations will therefore be needed, each having polymer pumps, pump drives, temperature control means, polymer piping, quenching facilities, take-off rolls, and related building space. The most difficult type of conjugate spinning is the concentric sheath-core type when one attempts to achieve a high filament density. One object of this invention is to provide a novel spin pack assembly to achieve high filament density while spinning concentric sheath-core fibers.

One effective prior art pack design for producing sheath-core fibers with a low filament density is disclosed in prior U.S. Pat. No. 2,936,482 (Kilian). In that pack design an upper orifice extrudes the filtered core polymer concentrically into a lead-in-hole of a spinning capillary. The sheath polymer is filtered in a second chamber and fed to flow radially outward from a central location through a common space and over a plateau surrounding the lead-in-hole so as to feed in around the core polymer. The two polymers flow together in laminar flow (plug flow) down through the lead-in-hole and then through a final spinning capillary, at which point the polymer emerges into the air and is cooled to form a bi-component fiber as shown in FIG. 14 of the Kilian patent. The Kilian spin pack provides a relatively short distance for each polymer to flow from the filtering chamber to the final spinning orifice, especially so in the case of the core polymer. However, Kilian's spin pack, because of free flow required in the common space for the centrally admitted sheath polymer, is only capable of relatively low spinneret filament densities. It is another object of the present invention to provide an improvement of the Kilian approach to formation concentric sheath-core bi-component filaments wherein a high spinneret filament density is obtained.

In melt spinning of synthetic fibers it is known that pumping the polymer through a filtering media (sand, screens, porous sintered metal, etc.) just prior to fiber extrusion tends to improve spinning performance. In sheath-core fibers, the core polymer generally provides the fiber strength and the sheath polymer has a lower melting temperature, enabling the fibers to be used in a non-woven fabric which can be bonded by subjecting the fabric to a temperature which will melt (or make "tacky") the sheath polymer without causing significant degradation to the strength of the core polymer. With this type of fiber it is very important that the core polymer pass through the final spinning orifice without a long delay after shearing takes place or else relaxation will offset the benefits of shearing. It is another object of the present invention to form sheath-core bi-component filaments in a manner which minimizes the polymer residence time in the spin pack.

There are two prior art spin packs which achieve high filament density in making sheath-core fibers. In U.S. Pat. No. 3,807,917 (Shimoda et al.), the spin pack assembly is designed for spinning polymer solutions, not melts, and no provision is made to keep a short residence time from the filtering and shearing media to the orifice. In fact, the Shimoda et al. assembly has no provision for filtering at all. In U.S. Pat. No. 4,052,146 (Sternberg), which is designed for molten polymer and does provide fairly high filament density, no means are disclosed for filtering or shearing the polymer and keeping the residence time short from shearing to fiber extrusion.

SUMMARY OF THE INVENTION

In accordance with the present invention, bi-component sheath-core fibers are fabricated by improving the method and apparatus described in the aforementioned Kilian patent. The sheath polymer, instead of being issued into the recessed space above the spinneret from a central location, is issued into that space, interspersed with core flow passages, in the form of ribbons at plural locations. Specifically, the sheath polymer is directed through preferably slot-like channels interspersed between rows of core polymer flow passages. The alternation of core polymer flow passage rows with sheath polymer flow channels results in space optimization and increased spinneret orifice density. In addition, since the sheath polymer is issued into the recessed space immediately adjacent the raised spinneret inlets, the sheath polymer flow path is relatively short (as compared to the prior art) so that the polymer residence time downstream from the filter is relatively short. The sheath flow channels extend from a sheath polymer manifold and filter, between the core flow passage rows, to respective egress slots above the recessed spinneret surface. In the preferred embodiment there are two sheath polymer manifolds disposed on opposite sides of a core polymer manifold. The sheath flow channels each include first and second sections extending from respective sheath polymer manifolds to a common juncture between a respective pair of adjacent core flow passage rows. A third section of the sheath flow channel extends downward from the common juncture to a respective egress slot. Of course, the sheath flow channels need not be slot-shaped as long as they are interspersed between the core flow channels at plural locations.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein.

DESCRIPTION OF PREFERRED EMBODIMENTS

Figure 1:
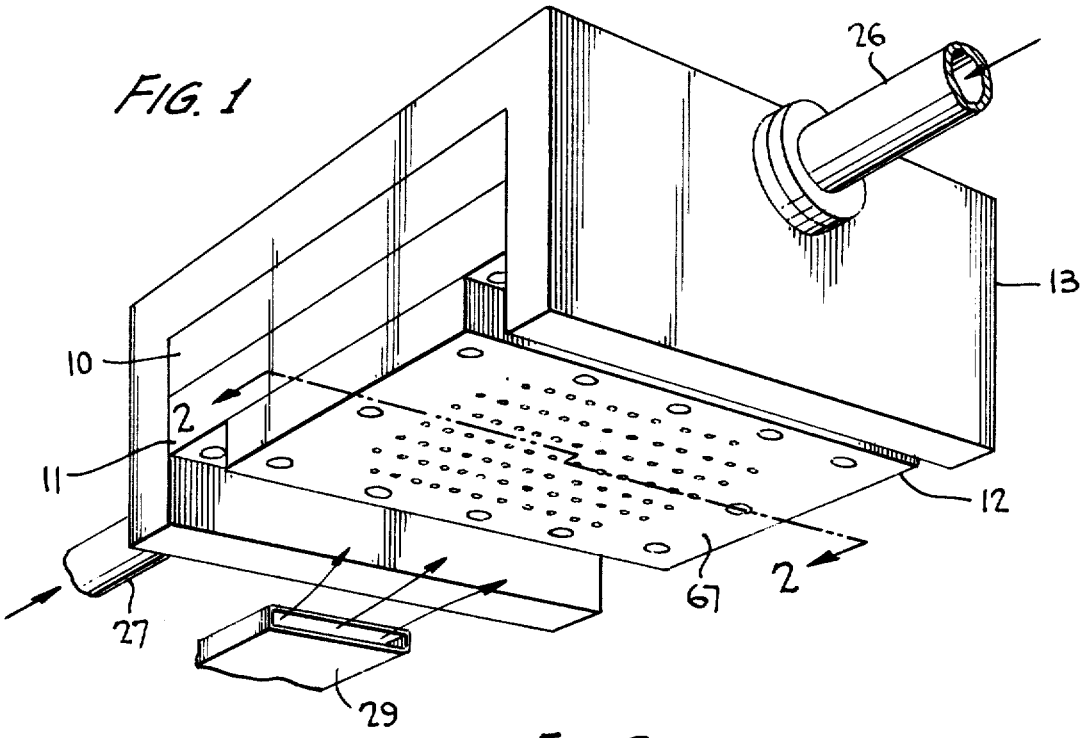
FIG. 1 is a view in perspective of a spin pack embodiment of the present invention.
Figure 2:
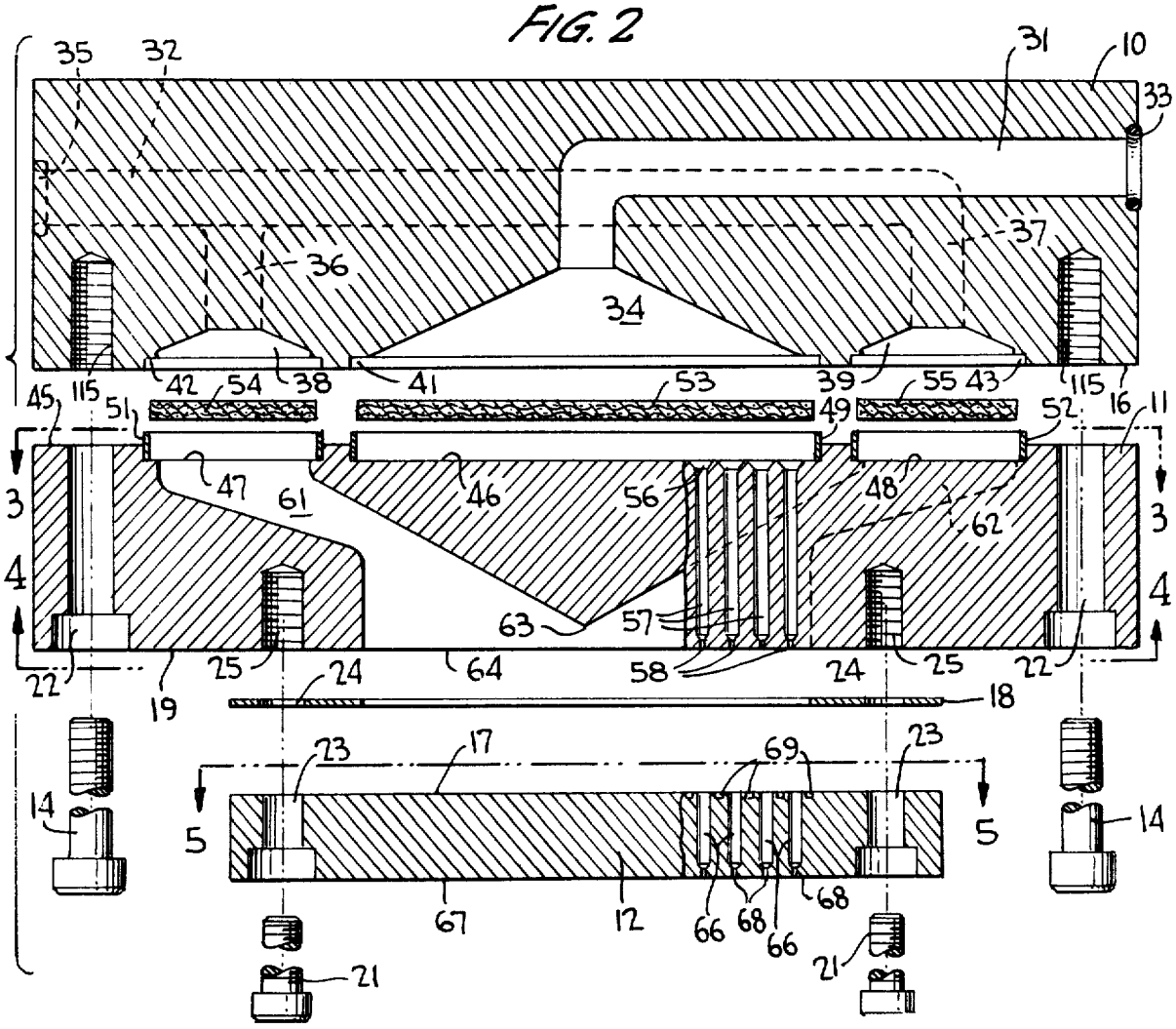
FIG. 2 is a partially exploded view in section taken along lines 2—2 of FIG. 1.
Figure 3:
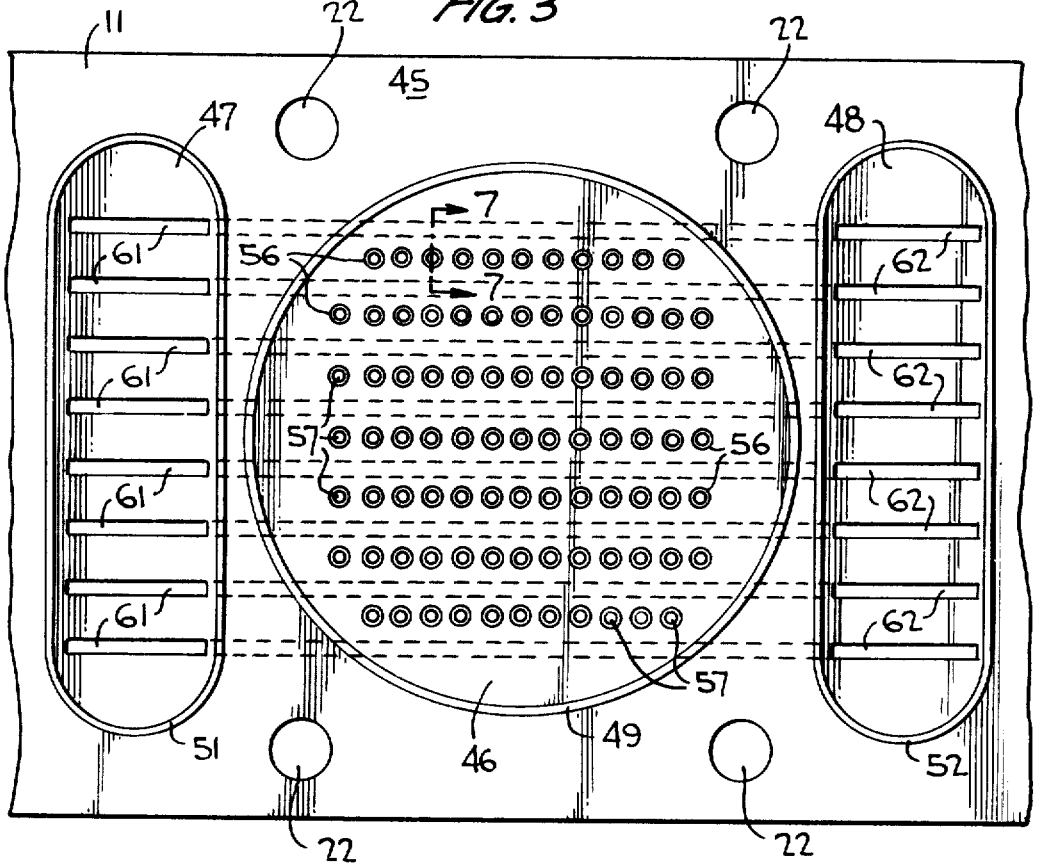
FIG. 3 is a plan view taken along lines 3—3 of FIG. 2.
Figure 4:
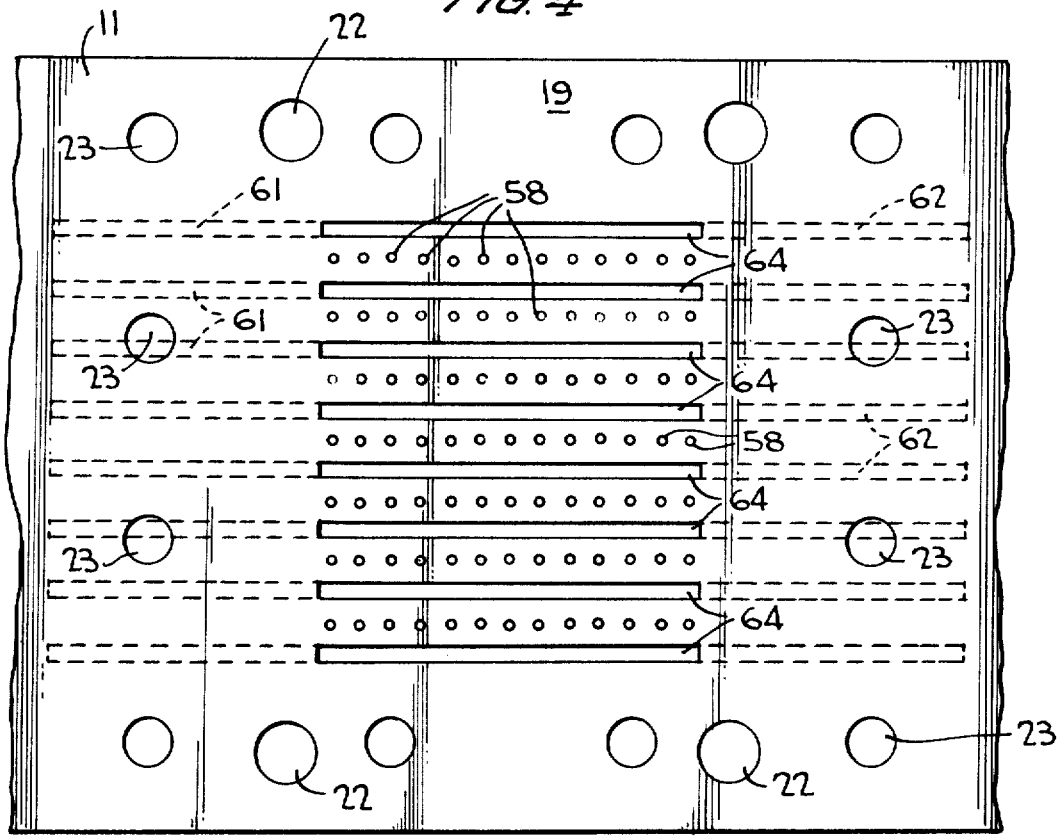
FIG. 4 is a plan view taken along lines 4—4 of FIG. 2.
Figure 5:
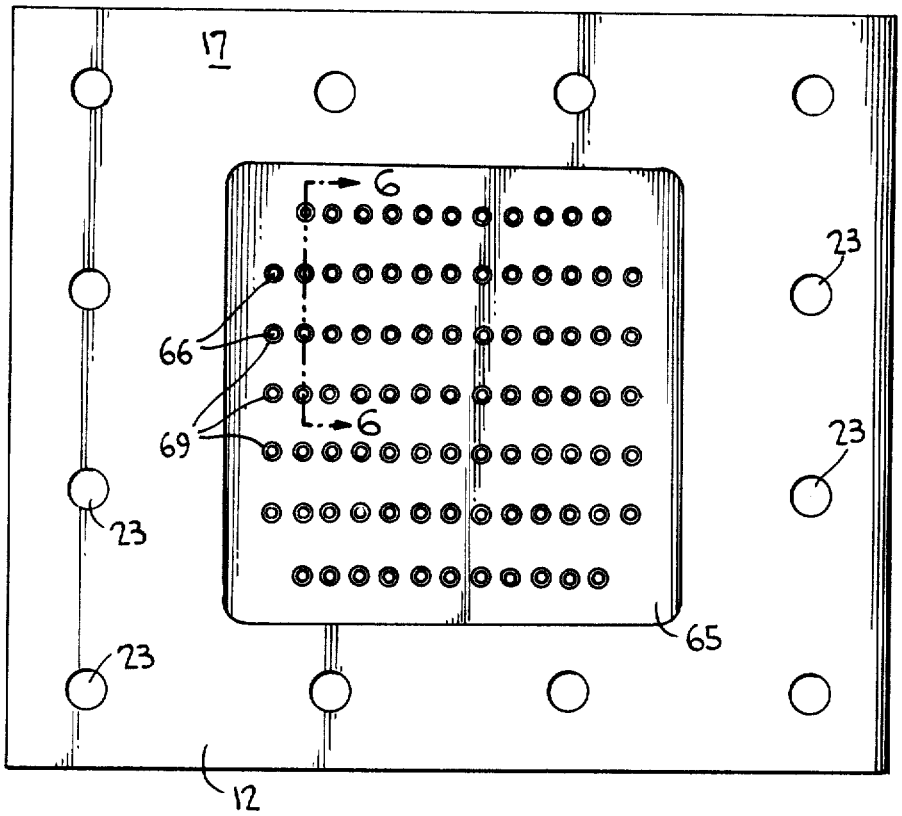
FIG. 5 is a plan view taken along lines 5—5 of FIG. 2.
Figure 6:
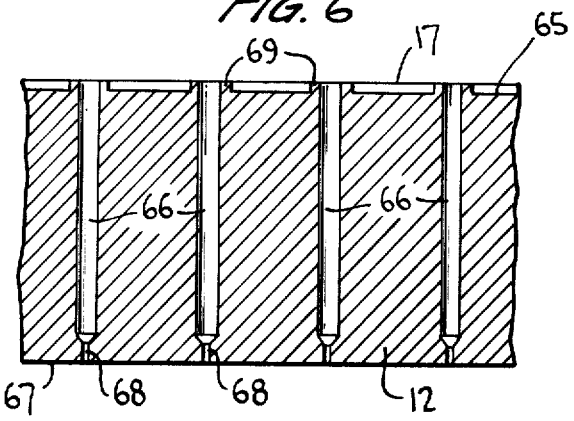
FIG. 6 is a view in section taken along lines 6—6 of FIG. 5.
Figure 7:
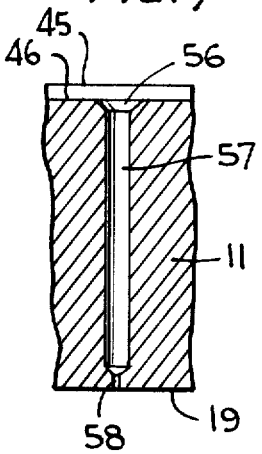
FIG. 7 is a view in section taken along lines 7—7 of FIG. 3.

Referring more specifically to the accompanying drawings, a spin pack according to the present invention may be fabricated from three stacked plates 10, 11 and 12 disposed in a frame 13. The frame 13 in an inverted U-shaped member having a cross-piece against which top plate 10 is secured by means of screws or the like. Center plate 11 is secured in abutting relation under top plate 10 by means of screws 14 which extend through countersunk through-holes 22 in center plate 11 to engage threaded bores 15 defined through the bottom surface 16 of top plate 10. The bottom or spinneret plate 12 has its top surface abutting the bottom side of a spacer 18 in the form of a shim and gasket, the top side of which abuts the bottom surface 19 of center plate 11. Spinneret plate 12, spacer 18 and center plate 11 are secured to one another by means of screws 21 which extend through countersunk through-holes 23 in the spinneret plate 12 and suitable apertures 24 in the spacer 18 to engage threaded bores 25 defined through bottom surface 19 into the center plate 11.

A supply tube 26 is secured to and extends from one side of frame 13 and serves the purpose of delivering pressurized molten core polymer to the spin pack from a suitable metering pump and extruder, or the like (not shown) in accordance with standard melt spinning practice. A second supply tube is secured to and extends from the opposite side of frame 13 and serves to deliver molten sheath polymer under pressure to the spin pack from a similar metering pump and extruder, or the like (not shown). Spun fibers which egress through the bottom surface 28 of spinneret plate 12 are exposed to cool air from a fan (not shown) which forces the air through a duct 29.

Top plate 10 has two supply passages 31, 32 drilled therein. Supply passage 31 extends from an inlet opening at one side of plate 10 in which a suitable polymer seal gasket 33 is disposed. Passage 31 communicates directly with tube 26 at this inlet and receives the molten core polymer under pressure. This core polymer supply passage extends generally horizontally and then bends downward at right angles to terminate centrally of plate 10 in an elongated conical region 34. This region defines a core polymer manifold and terminates with its widest open portion facing downward at surface 16. Supply passage 32 has an inlet at the opposite side of plate 10, there being a suitable polymer seal gasket 35 disposed at that inlet. Passage 32 communicates with tube 27 to receive pressurized molten sheath polymer at its inlet. This sheath polymer supply passage extends horizontally through plate 10 and has two subpassages 36, 37 extending perpendicularly downward therefrom to terminate in respective elongated pyramidal regions 38,39. Regions 38,39 define respective sheath polymer manifolds which are disposed on opposite sides of the core polymer manifold 34 and which terminate at surface 16. It should be noted that the core polymer manifold 34 and the two sheath polymer manifolds 38 and 39 are stepped to have slightly increased peripheries at surface 15. In other words, peripheral shoulder 41 is defined at the terminal end of manifold 34, while peripheral shoulders 42, 43 are defined at the terminal ends of manifolds 38, 39, respectively. It should be noted that the cross-sectional configurations of manifolds 34, 38 and 39 need not be circular and rectangular, respectively, as shown, but may take elliptical, square, or other configurations. It should be particularly noted that manifold 34 may have a rectangular cross-sectional configuration.

Middle plate 11 has a top surface 45 which has three discrete recessed areas 46, 47 and 48. Recess 46 is substantially centrally disposed and has a peripheral configuration which matches that of the termination of manifold 34 in plate 10 so that recess 48 defines the bottom of that manifold. Recesses 47 and 48 are disposed on opposite sides of recess 46 and have peripheries which conform to the peripheries of the terminations of manifolds 38 and 39, respectively, in plate 10. Recesses 47 and 48 define the bottoms of manifolds 38 and 39.

A polymer seal 49 (for example a soft aluminum gasket) is disposed in recess 46 along the periphery of that recess and extends upward to fit into peripheral shoulder 41 in plate 10. Similar seals 51, 52 are disposed in recesses 47 and 48 and project into peripheral shoulders 42 and 43, respectively. Filter screens 53, 54 and 55 are disposed in recesses 46, 47 and 48, respectively, and are abuttingly surrounded by respective seals 49, 51 and 52. These filter screens are preferably layers of woven wire screening with fine mesh on top and several coarser layers underneath. These screens are quite conventional in melt spinning and may be replaced by any of the various other filtering and shearng media commonly used in this field. Such media and their function are described in detail in an article entitled "Spin Pack Problems" by W. H. Hills which appeared in the April, 1978 issue of the "Fiber Producer" trade journal, which article is expressly incorporated herein by reference.

At the bottom of recess 46 there is defined a pattern of inlet openings 56 for respective core polymer flow passages 57. Passages 57 extend perpendicularly through center plate 11 and terminate at surface 19 in respective nozzles 58 arranged in the same pattern as the inlet openings 56. This pattern comprises an array of rows and columns of nozzles 58. The array is preferably rectangular and can have any desired number of rows and columns, depending upon the pressure of the core polymer, the length of passages 57 and the flow characteristics of the particular core polymer used. The array shown contemplates seven rows and thirteen columns with the four corner passages omitted to facilitate polymer sealing. This results in eighty seven passages which, in an actually constructed embodiment, have been arranged with the rows spaced 10 mm apart and columns spaced 5 mm apart. The resulting density of passages is approximately 2.0 passages per square centimeter, significantly higher than can be achieved in the spin pack described in the aforementioned Kilian patent. In another embodiment, the array included forty rows and fifteen columns, with the rows spaced by 8 mm and the columns spaced 5 mm with a resultant passage density of 2.5 per square centimeter. Even closer spacing is possible using the present invention.

At the bottom of recess 47 there are defined a plurality of slot-shaped channels 61 extending parallel to one another and to the rows core polymer flow passages 57. Adjacent channels 61 are spaced from one another by substantially the same distance between rows of passages 57; however, the channels 61 are aligned with the spaces between adjacent passage rows. The channels 61 extend obliquely downward through plate 11 to locations between respective adjacent pairs of rows of passages 57 so that the channels 61 are interleaved with or interspersed between the rows. Similar channels 62 are defined at recess 48 and extend obliquely downward (depending upon the orientation of the assembly) between respective adjacent pairs of rows of passages 57. Each channel 62 joins with a respective channel 61 at a respective juncture region 63 just prior to reaching surface 19 (or at surface 19, if desired) to define a common passage section which terminates in an outlet slot 64. Each adjacent pair of outlet slots 64 straddles a respective row of nozzles 58 at surface 19. The length of slots 64 is substantially the same as the length of each row of nozzles 58. The width of slot 64 is considerably less and, for the illustrated embodiment is typically 2 mm, leaving a substantial rib of metal in plate 11 between each channel in which nozzles 58 and passages 57 are drilled.

It should be noted that, although sheath polymer flow channels 61 and 62 are illustrated and described as being slot-shaped, this feature is merely a preferred embodiment and should not be considered as limiting the scope of the present invention. For example, each channel 61, 62 could be a plurality of round drilled holes, etc., as desired to convey the sheath polymer. Whatever the shape of the flow channels, it is the interspersing of core and sheath channels which is the important feature of the invention.

It is the interspersing of slots 64 between rows of nozzles 58 in plate 11 which permits optimal use of space and maximizing the nozzle density. It will be noted that the plural channels 61, 62 permit the sheath polymer to be issued from plural slots 64 at locations proximate core polymer nozzles 58 so that the sheath polymer does not have to travel the relatively large distance required in the Kilian patent wherein the sheath polymer is issued from a central location. Therefore, the residence time of the sheath polymer in the spin pack, downstream of filters 54, 55, is relatively short. Of course, this residence time can be further shortened by decreasing the thickness of plate 11 between surfaces 45 and 19, thereby shortening the lengths of passages 57 and channels 61 and 62. The limitation on shortening this plate dimension resides in the pressure of the molten polymer since plate 11 must be thick enough to prevent distortion thereby by the polymer pressure. This pressure is normally in the range of 1000 to 5000 psi upstream of the filter screens.

Gasket or shim 18 is in the form of a frame having an open central region which surrounds the array of nozzles 58 and slots 64. In this manner, polymer is issued from these nozzles and slots and flows freely to the top surface 17 of the spinneret plate 12. The thickness of gasket 18 is typically 0.2 mm.

Top surface 17 of spinneret plate 12 has a machined recess 65 of generally rectangular configuration which is large enough to surround the array of nozzles 58 and slots 64 in surface of plate 11. A plurality of spin holes or channels 66 are defined through the spinneret plate from within the recessed area 65 to the bottom surface 67 of the spinneret. Channels 66 terminate in respective nozzles 68 which issue the resulting bi-component sheath-core fibers formed in the spin pack. Each channel 66 is axially aligned with a respective nozzle 58 so that the core polymer flowing through passages 57 are issued directly into respective spinneret holes 66. In most applications the inlets for the spinneret holes are surrounded by respective raised portions or buttons 69 which project upwardly from recess 65 to a height flush with the un-recessed top surface 17 of spinneret plate 12. These buttons can be eliminated for certain combinations of sheath and core polymer where uniform sheath thickness is not important, by eliminating recess 65 and making shim 18 thicker. The locations of plate 12 relative to plate 11 to achieve perfect alignment of the spinneret holes 66 with respective nozzles 58 may be achieved by appropriate dowel pins (not shown) in a conventional manner.

In operation, the molten core polymer is forced through supply passage 31 to core manifold 34 where it passes through the filter 53 and is distributed to the various core polymer flow passages 57. The filter screens have two functions. First, they have a filtration function wherein they collect and remove from the polymer stream a variety of non-molten inclusions which are large enough in proportion to the diameter of a drawn fiber to cause fiber breakage either in the extrusion operation or in subsequent orientation stretching. The second function is shearing wherein gel-like masses are torn apart so that they comprise only a minor portion of the cross-sectional are of the polymer stream. The filtered and sheared core polymer flows through passages 57 and is issued by nozzles 58 directly into spinneret channels 66. The raised buttons 69 defining the inlets for channels 66 are spaced from the nozzles 58 by the thickness of gasket 18 so that the polymer streams are issued across this short gap.

The sheath polymer from supply passage 32 is likewise filtered and sheared at filter screens 54, 55 and distributed by manifolds 38, 39 to slot-shaped channels 61, 62. The flow in each channel 61 joins with the flow in a respective channel 62 to form a ribbon-like flow of sheath polymer which is issued from each egress slot 64. The ribbons of sheath polymer distribute the sheath polymer in recess 65 adjacent rows of buttons 69. The sheath polymer flows over the buttons 69 in the gap established by gasket 18 and enters spinneret channels 66 concentrically about the respective core polymer streams. The recess 65 is typically one to two millimeters in depth, affording little pressure drop to oppose the polymer in reaching the edge of each button 69; that is, this pressure drop is small relative to the pressure drop required to cause the sheath polymer to flow over the top surface of the buttons. The sheath polymer flows concentrically about the core polymer through channels 66 so that sheath-core bi-component fibers are issued from nozzles 68.

A spin pack embodiment was constructed essentially similar to the accompanying drawings. The spinneret 12 had eighty seven holes in a square pattern, with seven rows of holes spaced 10 mm from row to row. The orifices 66 were spaced 5 mm apart in each row, thirteen holes per row (i.e., thirteen columns). The four holes were left out to permit use of a proper polymer seal, leaving eighty seven holes. The core polymer orifices 58 were 0.6 mm in diameter feeding into the 1.5 mm diameter lead holes 66 of the spinneret 12. Each spinning orifice 66 had a 33 mm diameter button 69 around its entrance. A 0.010" (0.254 mm) thick shim 18 was used between the spinneret 12 and plate 11, resulting in a 0.010" gap for polymer to flow across the top of the buttons 69 and feed sheath polymer around the core polymer. Using two one inch Killion extruders, the above unit was first operated using polypropylene for both the sheath and the core, with green pigment added to the sheath polymer. The spinneret face temperature was 210° F. and the spin head was set at 232° C. Nine runs were made, adjusting the two extruder speeds to vary the thickness of the sheath. Each of the two polymers were varied in the range of 10 to 80 grams per minute per extruder. Extruder pressures were measured in the range of 300 to 600 psi for both streams during all of the runs. Fiber was allowed to wrap on a godet mounted to a d.c. motor and the wrap was pulled off between runs. This spin pack had a center plate 11 in which each sheath polymer slot 64 was 3 mm and had a volume of 7.2 $cm^3$, or 0.55 $cm^3$ for each of the thirteen orifices 69 fed by the slot. The core polymer passages 57 each had a volume of 0.23 $cm^3$. A very heavy plate 11, capable of withstanding the highest filtering pressures (as high as 8000 psi) was used. In a typical spin pack, the pressure is high (1500 to 6000 psi) upstream of the filtering screens, but is much lower between the screens and the spinning orifices (50 to 500 psi). Six additional runs were made with this unit. The first three of these were with the same green and white polypropylene. Blue-pigmented high density polyethylene (Hoechst GC7260) was put in the sheath extruder for the last three runs. In some of these, the flow rate was about six times as great for the core as for the sheath and a uniform thin layer of blue polymer surrounded each fiber when examined microscopically. While the sheath polymer was somewhat thinner in places than in others, all of the fibers seemed to have some sheath polymer around the entire periphery. In general, the trials were considered to be very successful with sheath/core bi-component fibers made with no changes needed in the hardward and with the sheath thickness readily varied.

I have found that the spin pack of the present invention can be designed with a filtering pressure capability (P) of at least 1000 psi, with a volume ($V_s$) of each sheath polymer flow channel 61, 62, 63 of less than 0.5 cubic centimeters, with a volume ($V_c$) of each core polymer flow passage 57 of less than 0.2 cubic centimeters and with a density (D) of spinneret orifices 68 of at least 2.0 orifices per square centimeter. Variations of these parameters in different combinations are possible for other embodiments, to wit: Embodiment A-P is at least 6000 psi, $V_s$ is less than 0.5 $cm^3$, $V_c$ is less than 0.2 $cm^3$, and D is at least 2.0 orifices per square centimeter; Embodiment B-P is at least 1500 psi, $V_s$ is less than 0.35 $cm^3$, $V_c$ is less than 0.1 $cm^3$, and D is at least 2.0; Embodiment C-P is at least 2500 psi, $V_s$ is less than 0.2 $cm^3$, $V_c$ is less than 0.1 $cm^3$, and D is at least 2.0; Embodiment D—like the first embodiment mentioned above wherein the spinneret orifices are arranged in an array of at least twenty rows having at least ten orifices per row; Embodiment E—like embodiment B wherein the spinneret orifices are arranged in at least twenty rows of at least ten orifices each; Embodiment F—like embodiment C wherein the spinneret orifices are arranged in at least twenty rows of at least ten orifices each; Embodiment G—like embodiment C wherein the spinneret orifices are arranged in at least thirty rows of at least thirteen orifices each.

A variety of different polymers can be used as is known in the prior art to form the sheath-core bi-component fibers. By way of example only, polypropylene, nylon and polyester may be employed as core or sheath materials.

In one embodiment I have been able to determine improved or shortened polymer residence times which depend upon polymer flow rate and the ratio of the amounts of sheath and core polymer in the final bi-component fiber. Typical residence times for different variations of these parameters are given in the following table, assuming the core to comprise 75% of the fiber:

| Yarn speed (undrawn) in m/min | Filament Denier (undrawn or partially drawn) | Total polymer flow (sheath and core) in gm/min | Core passage 57 residence time (in min) | Sheath channel 61, 62, 63 residence time (in min) |
|---|---|---|---|---|
| 700 | 55 | 4.27 | 0.0156 | 0.156 |
| 3300 | 7.6 | 2.78 | 0.024 | 0.24 |
| 1000 | 19.0 | 2.11 | 0.032 | 0.32 |
| 1200 | 6.0 | 0.80 | 0.084 | 0.835 |
| 4000 | 2.5 | 1.1 | 0.060 | 0.60 |

While I have described and illustratd specific embodiments of my invention, it will be clear that variations of the details of construction which are specifically illustrated and described may be resorted to without departing from the true spirit and scope of the invention as defined in the appended claims.

What I claim is:

1. A fiber extrusion spin-pack for the production of sheath-core bi-component fibers by melt spinning, said spin-pack comprising:

a spinneret having first and second opposite surfaces and a plurality of spaced polymer flow channels defined therethrough between said first and second surfaces, each flow channel having an inlet orifice defined within said first surface, said inlet orifices being arranged in a pattern of rows and columns along said first surface;

plural core polymer flow passages having respective ingress openings, each core polymer flow passage arranged in spaced axial alignment with a respective flow channel inlet orifice, said core polymer passages and inlet openings being arrayed in a pattern of columns and rows corresponding to the pattern of inlet orifices in said spinneret;

core polymer supply means for delivering pressurized molten core polymer to said plural core polymer flow passages;

core polymer filtering means disposed flush against said ingress openings between said core polymer supply means and said core polymer flow passages for filtering and shearing core polymer delivered to said core polymer flow passages;

wherein said core polymer flow passages define flow paths, from said filter means to respective spinneret inlet orifices, which are substantially equal in length and cross-sectional area to provide substantially equal core polymer pressure drops through said paths;

plural sheath polymer flow passages, each disposed substantially midway between respective rows of said core polymer flow passages, said sheath polymer flow passages each terminating in respective outlet openings aligned with respective spaces between rows of said spinneret inlet orifices and which are at least co-extensive with adjacent rows of spinneret inlet orifices;

sheath polymer supply means for delivery of pressurized molten sheath polymer of said sheath polymer flow passages; and sheath polymer filter means disposed between said sheath polymer supply means and said sheath polymer flow passages for filtering and shearing sheath polymer delivered to said sheath polymer flow passages.

2. The spin pack according to claim 1 wherein each sheath polymer flow passages has a cross-section with one relatively wide dimension and one relatively narrow dimension, said relatively wide dimension extending parallel to said rows, and wherein said outlet openings are elongated slots.

3. The spin pack according to claim 1 or 2, wherein said core polymer supply means includes a core polymer manifold disposed directly above said core polymer flow passages, said manifold having a bottom wall and arranged to receive pressurized molten core polymer and deliver same to said plural core polymer flow passages through said core polymer filtering means;

wherein said core polymer flow passage ingress openings are defined in said bottom wall of the core polymer manifold and extend from said bottom wall in mutually parallel relation;

wherein said core polymer filtering means comprises a filter screen disposed on said bottom wall of said core polymer manifold;

wherein said sheath polymer supply means includes at least one sheath polymer manifold having plural egress openings defined therein which serve as inlet openings for said plural sheath polymer flow passages, respectively; and wherein said sheath polymer flow passages extends from said manifold egress openings to said spinneret inlet orifices.

4. The spin pack according to claim 2, wherein said core polymer supply means includes a core polymer manifold disposed directly above said core polymer flow passages, said manifold having a bottom wall and arranged to receive pressurized molten core polymer and deliver same to said plural core polymer flow passages;

wherein said core polymer passage ingress openings are defined in said bottom wall of the core polymer manifold and extend downwardly from said bottom wall in mutually parallel relation;

wherein said core polymer filtering means comprises a filter screen disposed on said bottom wall of said core polymer manifold;

wherein said sheath polymer supply means includes two sheath polymer manifolds disposed on opposite sides of said core polymer manifold, each sheath polymer manifold having plural egress slots defined therein which serve as respective inlet openings for said plural polymer flow passages, repectively, there being one such egress slot from each sheath polymer manifold communicating with each of said sheath polymer flow passages; and wherein said sheath polymer flow passages each include first and second sections extending obliquely downward from said egress slots to join with one another at a juncture location above said outlet openings, and a third section extending from said juncture location to a respective outlet opening.

5. The spin pack according to claim 4 further comprising first, second and third vertically stacked plates, wherein said spinneret is formed in said first plate, said core and sheath polymer flow passages are formed in said second plate, and said core and sheath polymer supply means are formed in said third plate.

6. The spin pack according to claim 1 or 2 wherein said inlet orifices of said spinneret flow channels are defined in raised projections extending from said recessed portion of said first surface.

7. The spin pack according to claim 1 or 2 wherein said pattern or rows and columns is generally rectangular and wherein the spinneret flow channels have a density of at least two channels per square centimeter.

8. The spin pack according to claim 1 or 2 wherein the volume of each sheath polymer flow passage in its entirety is less than 0.5 cubic centimeters.

9. The spin pack according to claim 1 or 2 wherein the volume of each core polymer flow passage in its entirety is less than 0.2 cubic centimeters.

10. The spin pack according to claim 1 wherein said pattern includes at least twenty rows and at least ten columns of said inlet orifices.

11. The spin pack according to claim 3 wherein said filtering and shearing means is capable of withstanding pressures of at least 1000 psi.

12. The method of melt spinning sheath-core bi-component fibers of polymer material comprising the steps of:

filtering and shearing a flow of pressurized molten core polymer at the entrances to multiple flow channels of substantially equal length and cross-section;

directing multiple parallel streams of pressurized molten core polymer into respective spinneret flow channels from said multiple respective parallel flow passages positioned above and in axial alignment with the flow channels, said flow passages and flow channels each being arranged in a pattern of columns and rows;

flowing plural ribbons of pressurized molten sheath polymer from slots located substantially midway between respective rows of flow passages into a portion of the spinneret surrounding inlets to the spinneret flow channels; and directing the sheath polymer from said portion of the spinneret to flow into said flow channels about said core polymer streams.

13. The method according to claim 12 further comprising the step of issuing the bi-component sheath-core fibers from spinneret flow channels in said pattern of columns and rows with a density of at least two fibers per square centimeter.

14. The method according to claim 12 or 13 further comprising the step of:

filtering non-molten inclusions and shearing gel-like matter from the pressurized molten sheath polymer before the sheath polymer enters said slots.

15. The method according to claim 14 wherein the step of flowing plural ribbons includes directing the ribbons obliquely between the respective rows of flow passages toward said recessed portion of said spinneret.

16. A fiber extrusion spin pack for the production of sheath-core bi-component fibers comprising:

core polymer supply means for delivering molten core polymer under pressure;

sheath polymer supply means for delivering molten sheath polymer under pressure;

filter means for filtering and shearing the delivered molten sheath and core polymer, said filter means being capable of withstanding a molten polymer pressure P of at least 1000 psi;

a spinneret having a plurality of orifices for delivering said fibers, the density D of said orifices being at least two orifices per square centimeter;

a plurality of core polymer flow channels extending from said filter means for issuing molten core polymer streams into respective spinneret orifices, each core polymer flow channel having a volume Vc of less than 0.2 cubic centimeters; and a plurality of sheath polymer flow channels extending from said filter means for delivering molten sheath polymer to said spinneret orifices, each sheath flow channel having a volume Vs of less than 0.5 cubic centimeters per spinneret orifice served.

17. The spin pack according to claim 16 wherein P is at least 6000 psi.

18. The spin pack according to claim 16 wherein said spinneret orifices are arranged in a rectangular array having at least twenty rows of orifices and at least ten orifices per row.

19. The spin pack according to claim 16 or 18 wherein P is at least 1500 psi, Vs is less than 0.35 cubic centimeters, and Vc is less than 0.1 cubic centimeters.

20. The spin pack according to claim 16 or 18 wherein P is at least 2500 psi, Vs is less than 0.2 cubic centimeters and Vc is less than 0.1 cubic centimeters.

21. The spin pack according to claim 20 wherein said array has at least thirty rows of at least thirteen orifices each.

* * * * *